United States Patent [19]

Saxonmeyer

[11] 3,960,242

[45] June 1, 1976

[54] ORBITAL SERVICE BRIDGE

[75] Inventor: Wallace J. Saxonmeyer, Chicago Heights, Ill.

[73] Assignee: Whiting Corporation, Harvey, Ill.

[22] Filed: Dec. 1, 1972

[21] Appl. No.: 311,312

[52] U.S. Cl. ..... 182/36; 182/128; 182/142; 182/148

[51] Int. Cl.[2] ..... E04G 3/14

[58] Field of Search ..... 182/36, 128, 103, 104, 182/12, 97, 99, 141, 142, 148

[56] References Cited

UNITED STATES PATENTS

| | | | |
|---|---|---|---|
| 3,095,060 | 6/1963 | Reinhardt | 182/12 |
| 3,168,937 | 2/1965 | Redford | 182/148 |
| 3,503,467 | 3/1970 | Lindblad | 182/97 |
| 3,592,294 | 7/1971 | Allen | 182/103 |

FOREIGN PATENTS OR APPLICATIONS

| | | | |
|---|---|---|---|
| 43,536 | 12/1965 | Germany | 182/36 |

*Primary Examiner*—Reinaldo P. Machado
*Attorney, Agent, or Firm*—Lockwood, Dewey, Zickert & Alex

[57] ABSTRACT

An orbital service bridge for positioning a work platform at desired positions within an overlying dome-shaped structure comprises inclined leg members pivotally mounted at one end near the top of the dome. A motor driven trolley positions the other end of the leg member along a track circumferentially disposed on the base of the domed area. A carriage movably supported on the leg members positions the work platform at the desired height, and a telescoping mounting assembly extends the work platform in either direction away from the leg members and into the desired position. The bridge may also be assembled with complimentary leg members to form a self-supporting bridge structure useful in assembling the dome and related systems.

7 Claims, 13 Drawing Figures

20
27
28
4
30
4
42
57
49
41
50
46
47
32
26
37
37
37
37
43
44
48
40
39

ORBITAL SERVICE BRIDGE

BACKGROUND OF THE INVENTION

This application pertains in general to service bridges, and more particularly to service bridges for positioning a work platform at any desired location along the inside surface of a dome-shaped structure.

In recent years dome-shaped structures have come into wide use in large pillarless buildings, such as convention halls and sports arenas, and in nuclear power plants, where they are used for isolating the nuclear reactor areas of the plants from the surrounding environment. In the latter case, the containment domes are typically constructed of reinforced concrete, and are usually provided with a steel liner to present a non-porous contamination-free surface to the area around the reactor. A water spray system comprising a plurality of pipes spaced near the inner surface of the containment dome with nozzles directed thereon is provided for flushing the inner surface with water to wash away contaminants in the event of an explosion within the reactor.

While dome-shaped structures have been generally satisfactory and effective as structural building components, they have also provided unique maintenance problems. This is because no practical means has heretofore existed for conveniently reaching all locations within the inside surface of such domes for the purpose of accomplishing repairs and inspections. The problem is particularly acute in nuclear power plants, where the inner liner of the containment dome must be periodically inspected and the water spray system periodically maintained. Heretofore it has been necessary to erect temporary scaffolding to inspect and maintain dome-shaped structures, which is at best a difficult, time-consuming and expensive process.

Accordingly, it is a general object of the present invention to provide a service bridge for providing ready access at all times to desired work locations within an overlying dome-shaped structure.

It is a more specific object of the present invention to provide a service bridge for positioning a work platform at a desired work location within an overlying dome-shaped structure.

It is a still more specific object of the present invention to provide a new and improved service bridge for positioning a work platform along the inside surface of an overlying dome-shaped structure.

It is still another specific object of the present invention to provide a service bridge for positioning a work platform at any desired location within a frusto-conical work area.

It is still another specific object of the present invention to provide a method of assembling an orbital service bridge capable of positioning a work platform at desired work locations within an overlying dome-shaped structure.

It is still another specific object of the present invention to provide a method of assembling a containment dome and associated water spray system in a nuclear power plant.

It is still another specific object of the present invention to provide a new and improved water spray system for washing away contaminants from the inside surface of the containment dome of a nuclear power plant.

The invention is directed to an orbital service bridge for positioning a work platform at a desired work location within an overlying dome-shaped structure. The bridge comprises pivotal support means disposed near the top of the overlying dome, and a pair of joined-together elongated leg members having one end pivotally supported by the pivotal support means. Positioning means comprising an end truck at the other end of the leg members are provided for positioning the other end along a track circumferentially disposed on the base of the domed area. Means comprising a carriage movably supported on the leg members are provided for positioning the work platform at the height of the desired work location, and means are provided for extending the work platform away from the leg members toward the desired location.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in connection with the accompanying drawings, in the several figures of which like reference numerals identify like elements, and in which:

DESCRIPTION OF THE PREFERRED EMBODIMENT

Figure 1:
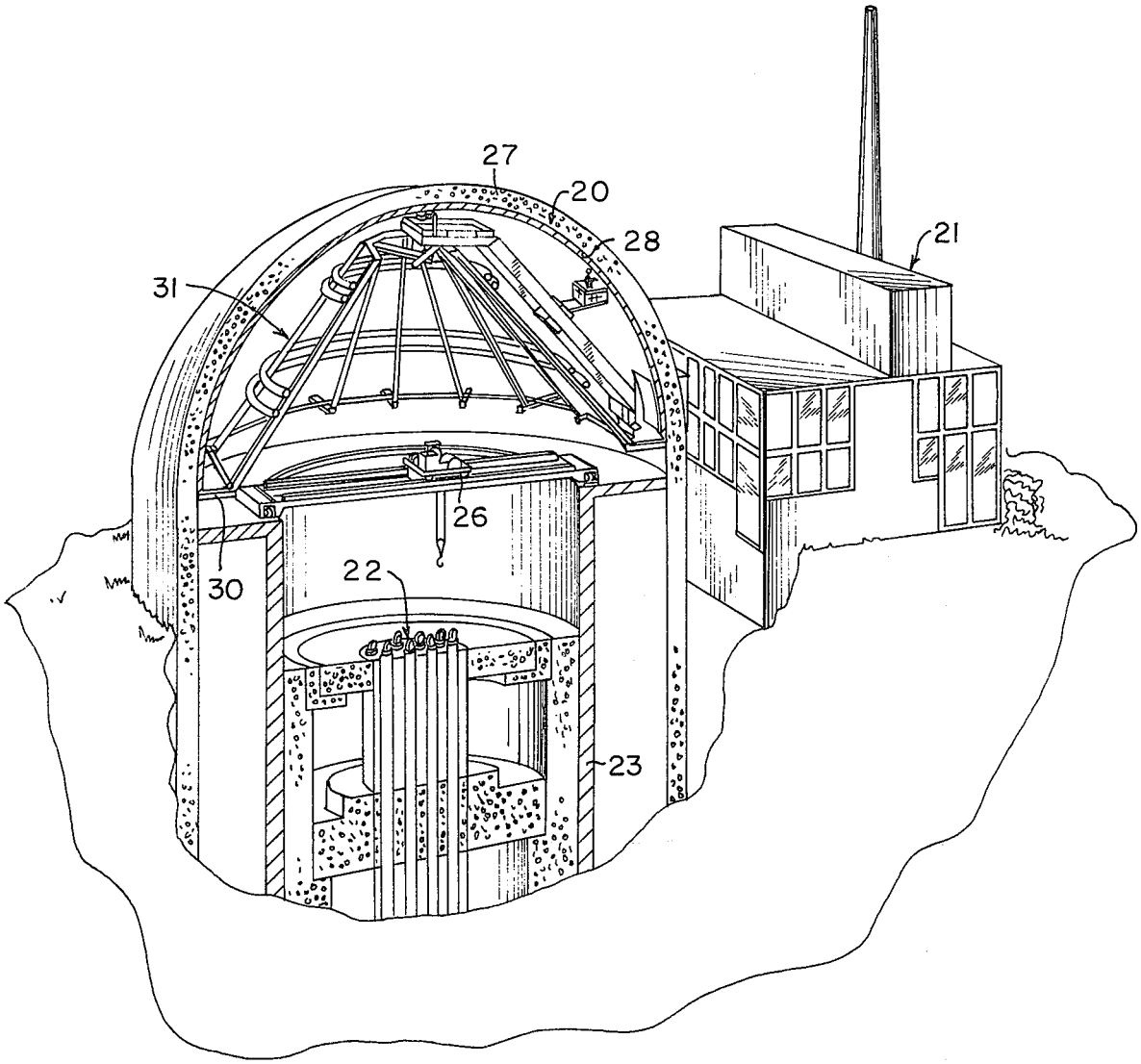
FIG. 1 is a perspective view, partially fragmentary, of a nuclear power station of the type having a containment dome enclosing its nuclear reactor area.

Referring to FIG. 1, the invention is shown incorporated within the containment dome 20 of a nuclear power plant 21, which may be entirely conventional in design and operation. The dome overlies a nuclear reactor 22, the reactor being contained below ground within a concrete silo 23 and having an access opening in the floor of the area enclosed by the containment dome. A polar crane 26 spans the top of the reactor to facilitate installation, service and general maintenance of the reactor as it becomes necessary during operation of the plant. Heat energy generated as a result of nuclear activity within the pile is transferred by conventional liquid circulation systems to an adjacent generating plant, wherein it is utilized to turn electric generators to generate electric power.

The reactor containment dome 20, which is constructed of an external layer 27 of reinforced concrete or similar high strength material and an internal steel liner 28, completely overlies the reactor and polar crane so as to isolate the reactor from the surrounding environment. To that end, the dome may be subatmospheric and provided with appropriate interlocks at all entrances and exits. A steel liner 28 is provided on the inside.

Figure 2:
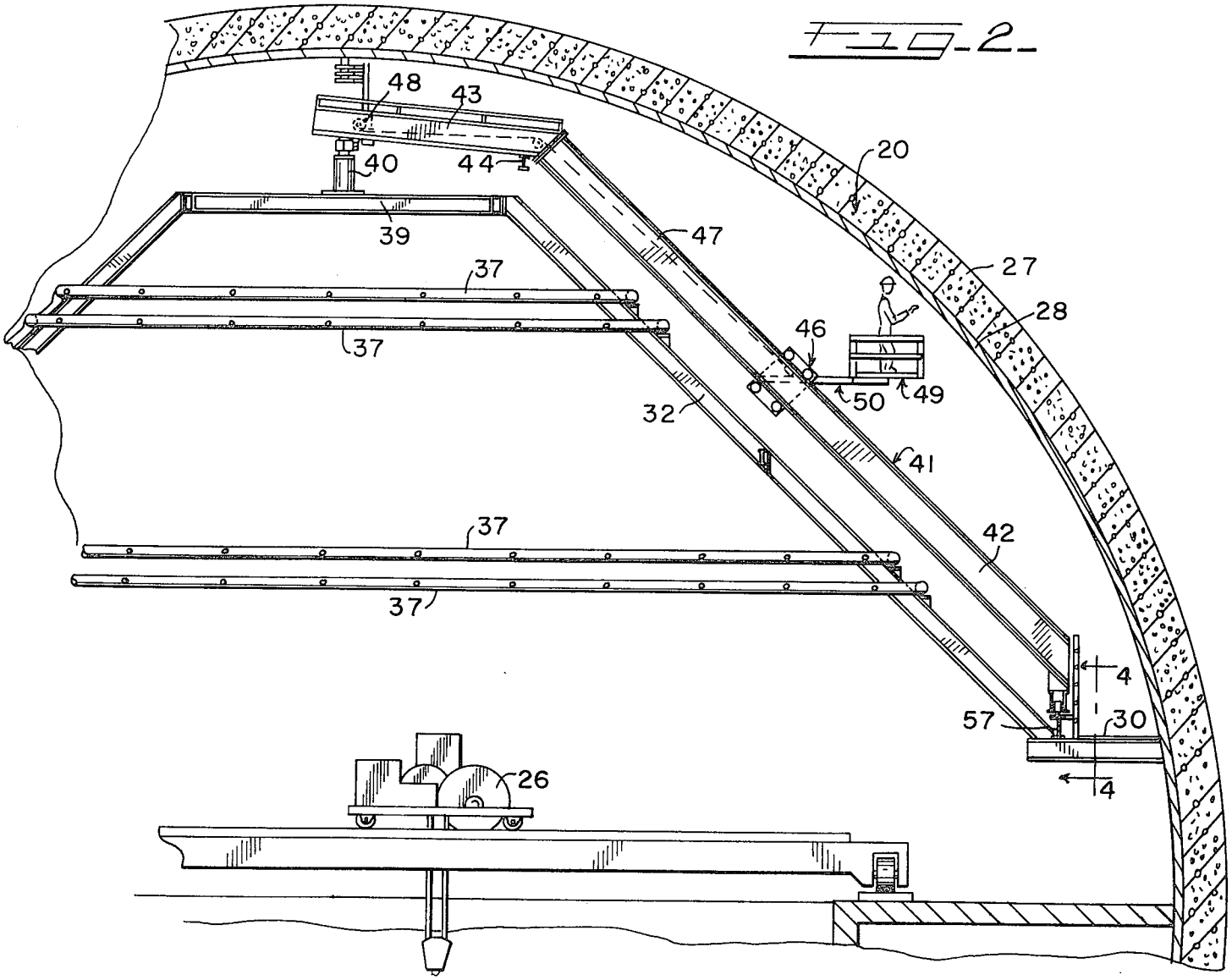
FIG. 2 is a front elevational view of an orbital service bridge constructed in accordance with the invention within the containment dome of FIG. 1 and pivotally supported from the supporting framework of a spray system associated with the dome.
Figure 3:
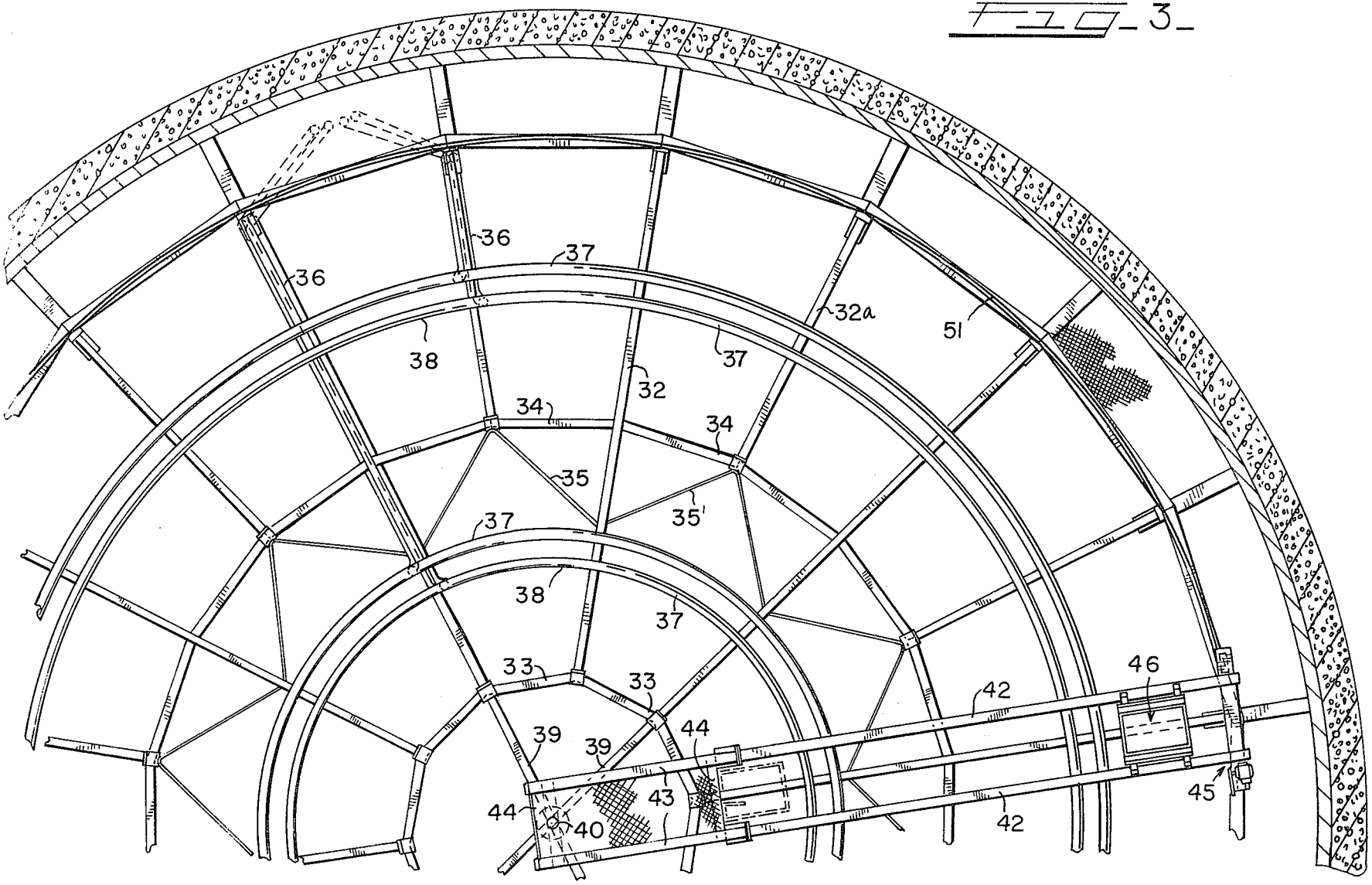
FIG. 3 is a top view of the orbital service bridge and the supporting framework of the water spray system of FIG. 2.

A water spray system 31, which functions in the event of reactor malfunction to wash the inside surface of the containment dome with water to flush away radioactive contaminants, is supported by beams extending inwardly from the lower portion of the dome. Referring to FIGS. 2 and 3, the framework of the water spray system comprises a total of twenty individual inclined struts 32 and 32a, struts 32 extending from the dome-supported beams to cross members 33, which encircle the framework at its top, and struts 32a extending to cross members 34, which encircle the framework at its mid-section. A plurality of tie rods 35 may be employed for added structural rigidity between the middle cross supports and the top cross supports.

The containment dome spray system framework supports a plurality of header pipes 36 which bring water for washing the inside surface of the dome up to various levels on the framework. These pipes run parallel to inclined leg members 32, and branch to encircle the frame work at discrete levels in rings 37 of progressively increasing diameter from top to bottom of the dome. A plurality of nozzles 38 are arranged at spaced intervals along the rings to obtain a uniform spray pattern over the entire interior surface of the dome. The spray system framework includes two cross members 39 at its top or truncated portion which provide a platform on which a pivotal support bearing assembly 40 is mounted. As will be seen presently, this pivotal support assembly comprises part of an orbital service bridge for servicing water spray system 31 and the interior surface of containment dome 20.

In accordance with the invention, access is gained to the interior surface of dome 20 by means of an orbital service bridge 41. Basically, this bridge comprises a pair of parallel spaced-apart inclined leg members 42 fastened at their upper end to a pair of parallel like-spaced substantially horizontal span members 43. The span members are connected at either end by a pair of cross members 44, which serve to maintain the spacing constant and provide a surface for attachment to pivotal support assembly 40. A railing may be included above the span members to facilitate servicing the top portion of the dome. The resulting assembly is supported at its top end by pivotal support assembly 40 and at its bottom end by positioning means in the form of an end truck 45.

A work platform carriage 46 is carried on rollers between inclined bridge members 42, and is held at any desired position along the inclined members by means of a pair of cables 47 disposed on either side of the carriage, adjacent respective ones of the leg members. A winch 48 common to the two cables is provided to raise and lower the carriage. A work platform 49 is mounted on carriage 46 and is able to extend in a horizontal direction away from the carriage by virtue of a telescoping support assembly 50. Thus, work platform 49 can extend outwardly to a location adjacent the dome to service that surface, or can extend inwardly to the water spray system framework to permit servicing that structure.

Figure 5:
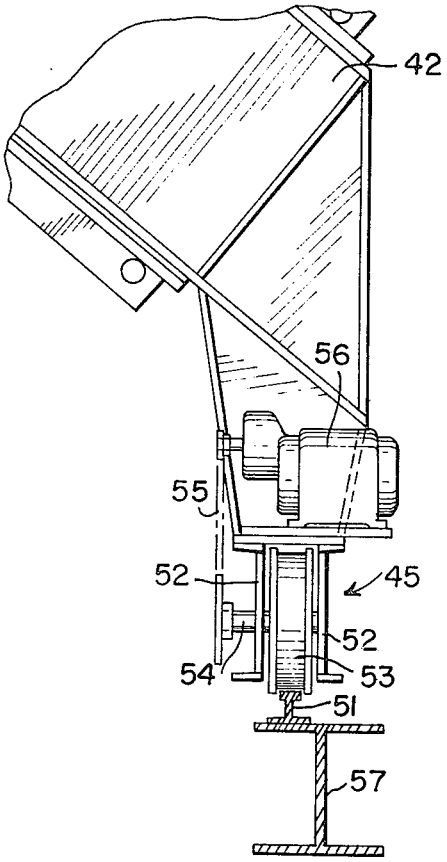
FIG. 5 is an end view of the end truck taken on line 5—5 of FIG. 4.
Figure 4:
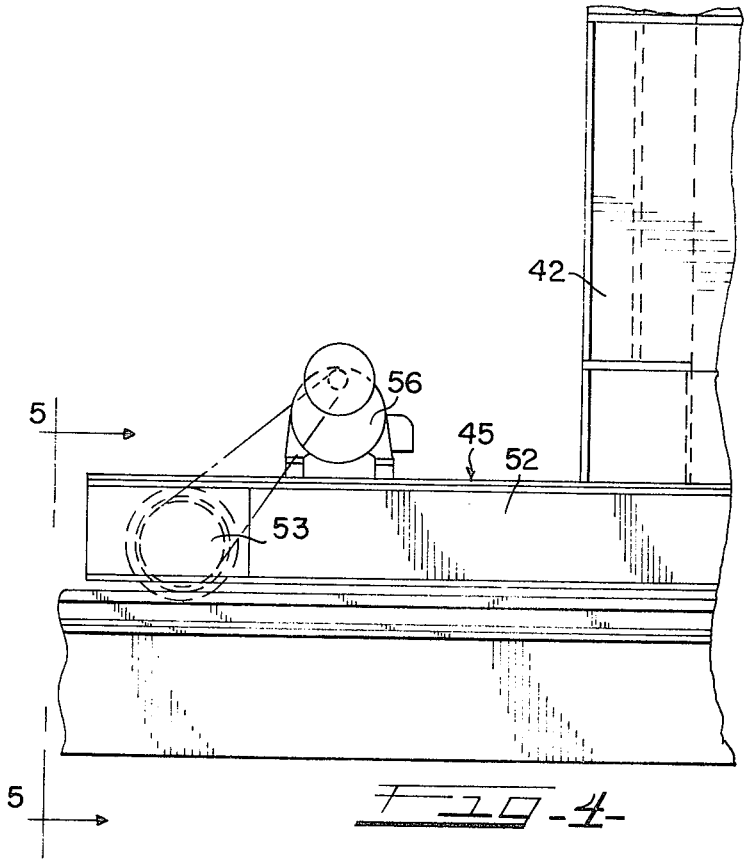
FIG. 4 is a side view of a portion of the end truck for the leg members of the orbital service bridge of FIG. 2.

Referring to FIGS. 4 and 5, end truck 45 moves about the circumference of the base of the dome on a rail 51. The base of the dome as referred to herein defined by a plane extending within the dome which perpendicularly crosses the axis of the dome at a selected point above but preferably near the real or imagined floor of the area enclosed by the dome, or in the case of a silo-shaped structure, at a selected point above or near the plane in which the spring lines defined by the cylindrical base portion meets the arcuate line segments defined by the dome portion. Basically, the end truck comprises a channular frame member 52 to which the inclined leg members 42 are attached. A drive wheel 53 is rotatably carried within the channel of the trolley frame member by means of an axle 54 and suitable bearings on the trolley frame. Power is supplied to the drive wheel by means of a chain and sprocket assembly 55 which couples the axle to a motor 56, the motor preferably being reversible and including an integral gear reduction assembly. It will be appreciated that other types of rotational coupling arrangements can be used here as well, such as an enclosed gear train drive or a belt and pulley drive. The trolley drive wheel 53 may be double-flanged to engage rail 51, which is carried on an I-beam 57 or similar support mounted to the bottom of the dome. An additional double-flanged wheel (not shown) is similarly mounted at the frame member 52 to support the other end of the end truck. For operator convenience, the drive motor 56 is preferably controlled from work platform 49, and power for the motor is preferably obtained by means of sliding pick-ups and conductors disposed adjacent bridge support assembly 40.

Figure 8:
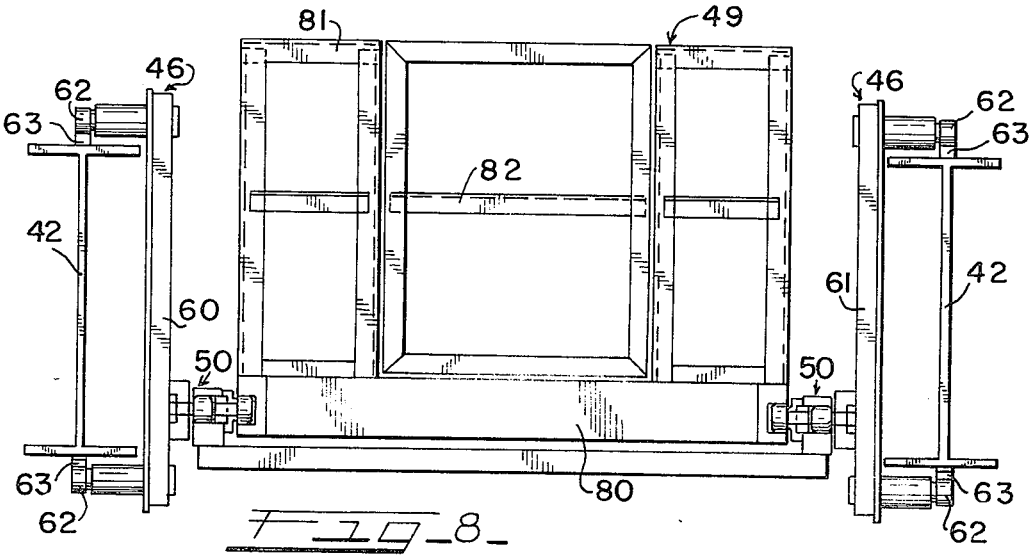
FIG. 8 is an end view of the work platform and the work platform support assembly taken on line 8—8 of FIG. 7.

Carriage 46, as seen in cross-section in FIG. 8, comprises a pair of parallel spaced-apart end plates 60 and 61 disposed on the inside of an adjacent to respective ones of the inclined leg members 42. The end plates are each slidably supported on their respective leg members by means of rollers 62, which engage track surfaces 63 provided on the top and bottom of the I-beam shaped leg membes 42. These rollers 62 may have either a flat surface to engage a like track surface, or may be flanged to engage a rail-like track surface on the leg members. One or more cross members may be provided between the end plates to cause them to track closely as they move up and down their respective inclined leg members 42 and to provide a more stable support for the work platform 49.

Referring again to FIG. 6, the two cables 47 which support the work platform carriage 46 are seen to extend from winch 48, around pulleys 64, and down parallel to leg members 42 to the carriage. Winch 48 is driven by a reversible electric motor (not shown), and for operator convenience is preferably controlled from work platform 49. The two cables 47 are attached to carriage 46 by means of a pair of spring-loaded safety brake assemblies 65, which prevent the carriage from rolling down inclined member 42 should one or both of the cables break.

Figure 9:
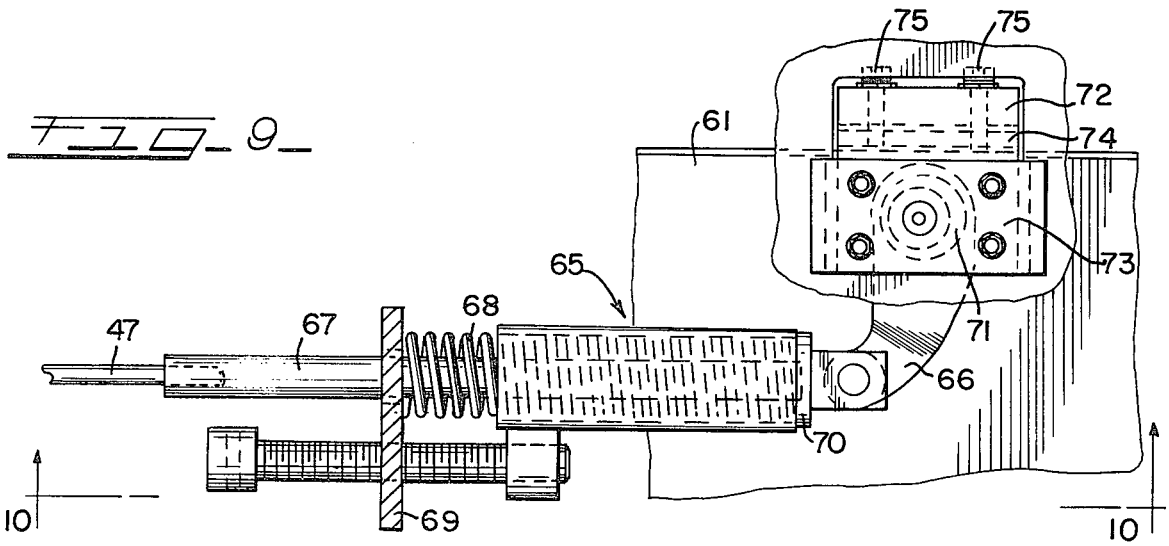
FIG. 9 is a side view, partially fragmentary and partially in cross-section, of the safety brake assembly for the work platform carriage of the service bridge of FIG. 2.
Figure 10:
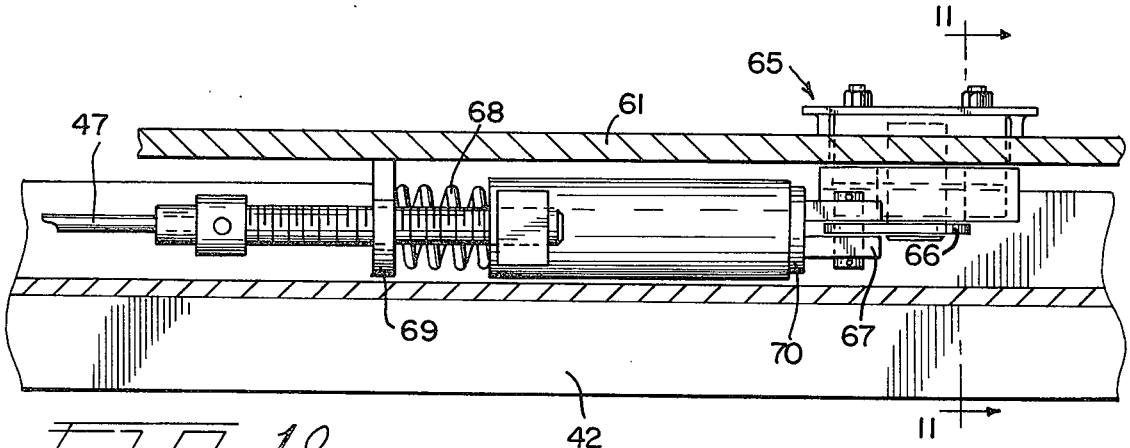
FIG. 10 is a cross-sectional view, partly in section, taken along line 10—10 of FIG. 9.
Figure 11:
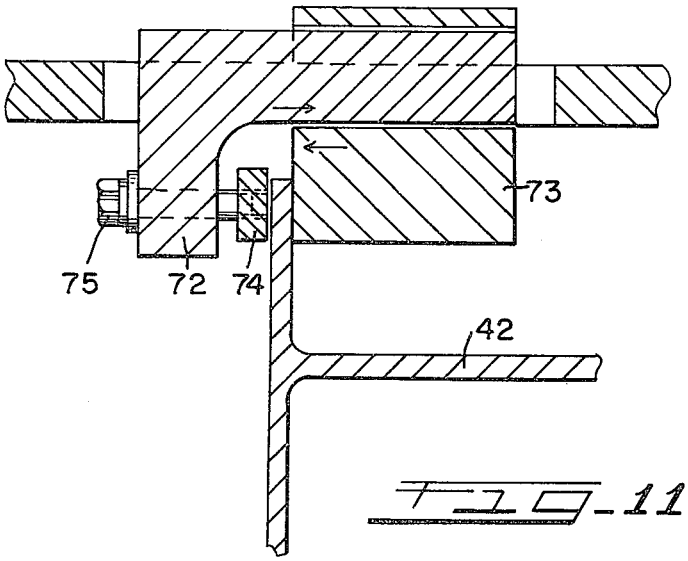
FIG. 11 is a cross-sectional view taken along line 11—11 of FIG. 10.

The two safety brake assemblies 65, as shown in FIG. 9–11, each comprises a lever 66 pivotally mounted to the outside surface of a respective one of the two end plates 60 and 61. In the case of the brake assembly associated with end plate 60, the respective one of calbes 47 is connected by connecting link 67 to the free end of lever 66 so as to pivot it clockwise, as viewed in FIG. 9. The connecting link 67 extends through the center of a compression spring 68, one end of which is attached to the carriage end plate 60 by an adjustable bracket 69, and the other end of which is received by and bears against a cylindrical bracket 70 attached to arm 66. This arrangement has the effect of exerting a constant counterclockwise force on lever 66 in opposition to that exerted by cable 47, so that should tension on the cable be released the lever 66 will rotate in a counterclockwise direction and set the brake. When lever 66 rotates in a counterclockwise direction an eccentric cam surface 71 near its pivot point forces a pair of brake actuator blocks 72 and 73 toward each other. This in turn forces a brake shoe 74, carried on block 72 by adjustment bolts 75, to frictionally engage the inclined I-beam shaped leg member 42 and thereby preclude further motion of the carriage. It will be appreciated that when cable 47 is under adequate tension to overcome its associated spring 18, lever 66 is rotated clockwise and brake shoe 74 is withdrawn from engagement with member 42.

Figures 6, 7:
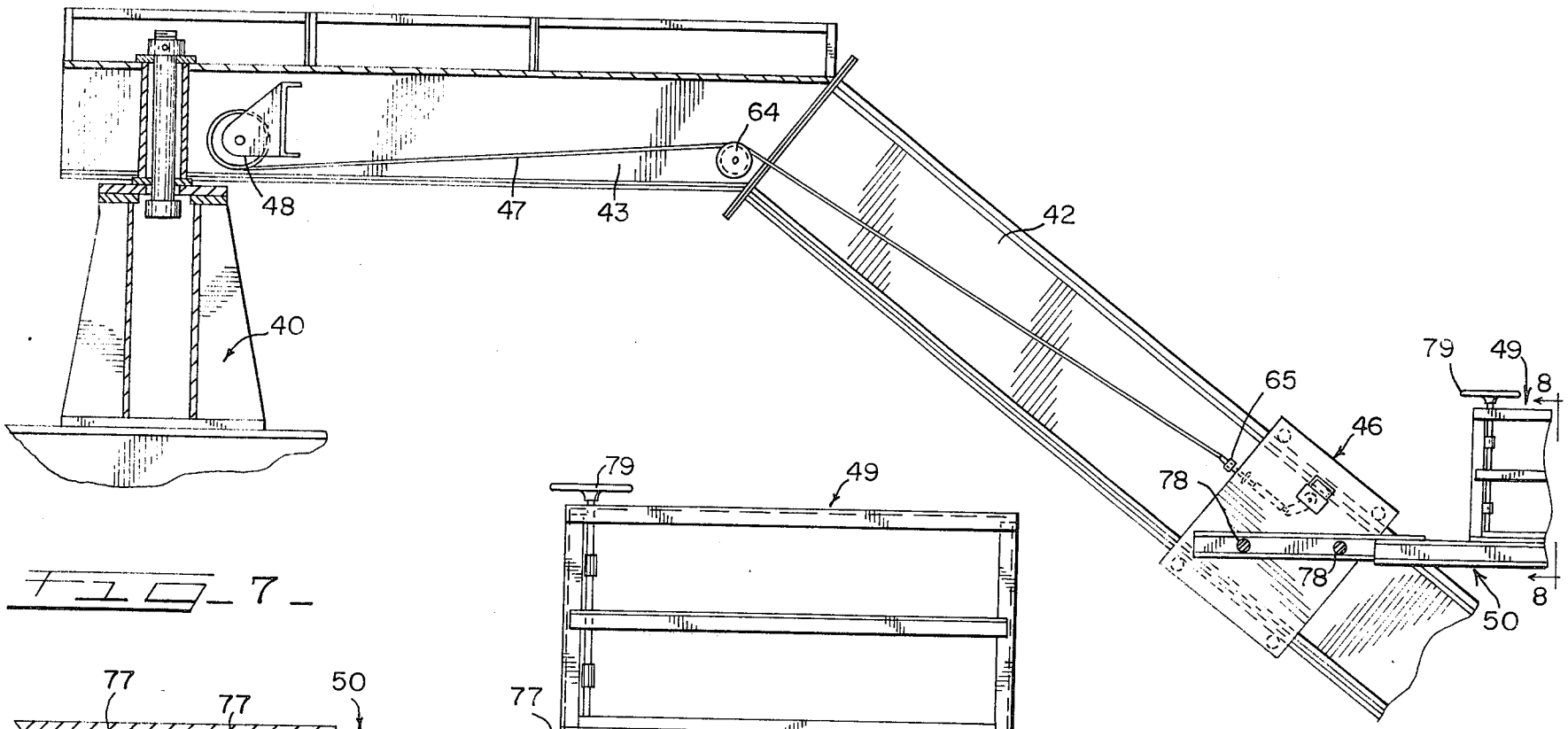
FIG. 6 is a side elevational view, partially in cross-section, of the top end of the inclined leg member, the span member, and the pivotal support of the orbital service bridge of FIG. 2.
FIG. 7 is a side elevational view of the work platform and telescoping work platform support assembly of the orbital service bridge of FIG. 2.

As pointed out above, work platform 49 is able to extend away from carriage 46 by virtue of a telescoping rail assembly 50 provided between the platform and the carriage. This assembly, which may be entirely conventional in design and construction, is seen in FIG. 7 to comprise a plurality of interlocking channular support members 76 and coacting rollers 77 positioned between the carriage end plates 60 and 61 and their respective sides of the work platform. The channular support members adjacent the carriage end plates are fastened to the inside surfaces of the respective end plates by means of bolts 78, or other appropriate fastening means. The work platform is positioned by means of a hand wheel 79 which operates a rack and pinion gear (not shown) beneath the platform. The operation of this drive, and the details of the telescoping assembly, are well known to the art and need not be covered in detail here. It will be appreciated that other types of telescoping assemblies could be used instead, and that a reversible motor drive could be used in place of hand wheel 79.

The work platform 49 comprises a platform 80 (FIG. 8) which includes a framework for receiving the channular rails of telescoping rail assembly 50. A hand railing 81 encircles the platform and a hinged door 82 is provided at one end to facilitate entry and exit from the work cage.

Figure 12:
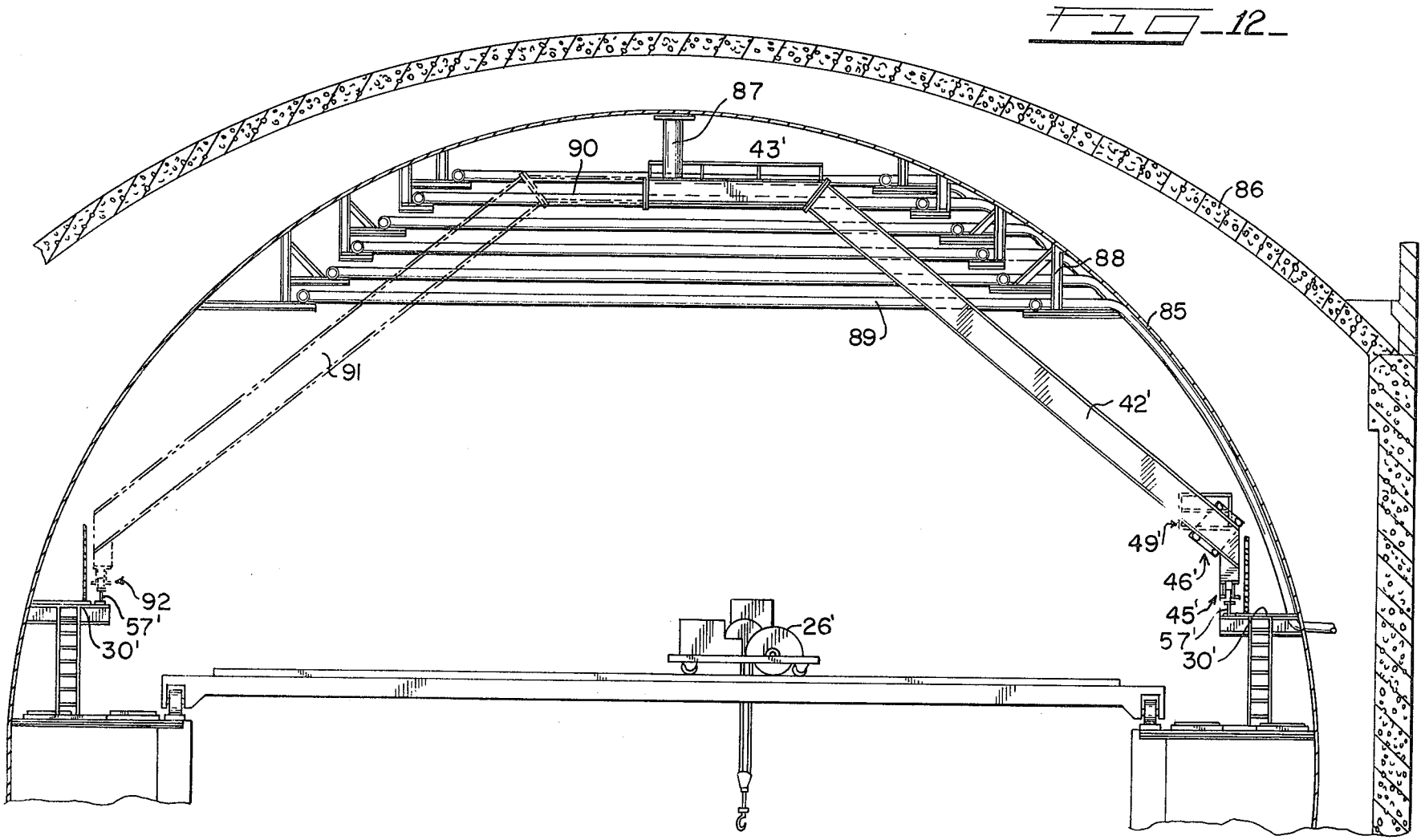
FIG. 12 is a front elevational view of an alternate construction for a nuclear power plant containment dome wherein the orbital service bridge is pivotally supported from the dome.
Figure 13:
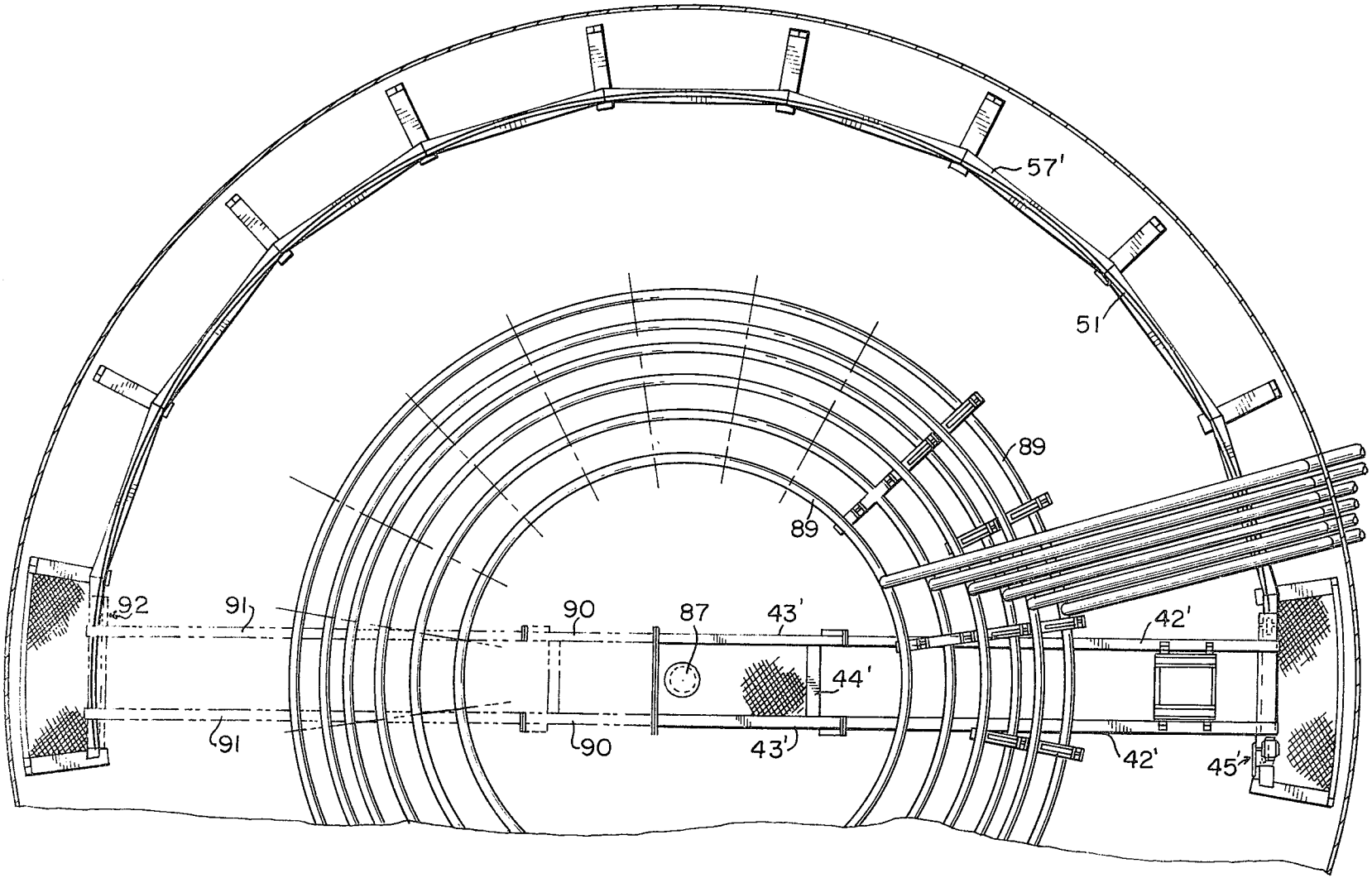
FIG. 13 is a top view of the alternate construction of FIG. 12.

In certain types of nuclear power plant applications it may be desirable to mount the water spray system directly on the steel shell of the containment dome. Accordingly, in FIGS. 12 and 13 an alternative containment dome construction is shown wherein a steel dome-shaped shell 85 is structurally separate from an overlying concrete dome 86. In this case, the steel shell supports a pivotal support member 87 which extends down from the center of the dome to pivotally support the horizontal span member 43 of the orbital service ridge 41'. The steel shell is also equipped with a plurality of support brackets 88 on which a plurality of water spray system pipes 89 are disposed in rings of progressively increasing diameter from top to bottom. As in the previously described embodiment, appropriately positioned nozzles are provided on these pipes to obtain a complete and thorough washing of the inside surface of the steel liner of containment dome 85.

While this construction offers certain advantages in fabrication over that previously described, it does have the disadvantage of impeding access to the interior surface of the dome. However, the orbital service bridge is nevertheless of great benefit with this construction in that it provides the capability of positioning the work platform at any desired location near the dome for the purpose of installing or repairing either the water spray system pipes or sections of the inner surface of the dome.

When installing the orbital service bridge of the present invention it is often advantageous to initially assemble the bridge as a self-supporting unit. This is accomplished by assembling an additional pair of spaced-apart span members 90 to form an arch-shaped bridge assembly spanning the entire diameter of the dome. An additional end truck 92 is provided at the end of the added leg members to engage rail 56 so that the entire assembly can be turned about the axis of the dome. It will be appreciated that with only a slight sacrific in lift capability and stability the bridge can also be assembled as a free-standing unit by adding a single span member and a single inclined leg member instead of paired spaced-apart members as shown.

The arch-shaped bridge assembly is normally assembled on the ground, and then lifted into position on the rail. It will be appreciated that the bridge in this configuration is self-supporting and can be utilized to erect the overlying containment dome and to install pipes of the water spray system. In the earlier described embodiment (FIGS. 1–11), wherein a separate basket-like support framework is provided for the water spray system, the orbital bridge can also be utilized while in its symmetrical free-standing condition to assemble the support framework of the water spray system. Then, when the framework is up and the pivotal support member 40 has been installed, the added inclined leg and span members can be removed to conserve space within the dome, while the remaining single leg orbital service bridge will be utilized for access to the dome and the spray system throughout the life of the power plant.

The orbital service bridge in its symmetrical configuration provides additional lifting capacity in that it does not rely on an external pivot support member. Thus, in applications where it is anticipated that heavy loads will be lifted, the service bridge can be left assembled in its symmetrical configuration within the dome. However, where space is at a premium and no heavy lifting is anticipated, the pivotal support member can be installed and the added span and leg members removed to conserve space. A hoist may be provided on the work platform for lifting light loads.

It will be appreciated that while the orbital service bridge has been shown within the containment dome of a nuclear power plant, its structure and operation make it well suited for other applications. For instance, it would be useful in auditoriums, planetariums, observatories and sports arenas, and in other dome-shaped buildings where the need for servicing the inside of an overlying domed shaped structure arises.

Thus, a novel orbital service bridge has been shown and described which permits a work platform to be positioned at a selected location within an overlying dome without the need for center supports or scaffolding. The service bridge is light in weight and easy to assemble, requiring a minimum of structural components and no complicated pulley or drive belt arrangements. The service bridge provides maximum operator convenience and flexibility, and is adaptable to a wide variety of uses. Furthermore, the service bridge, in combination with the described internal water spray system, provides a compact and efficient structure for servicing the containment dome of a nuclear power plant.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. An orbital service bridge for positioning a work platform at a desired work location within an overlying dome-shaped structure, comprising;

a pair of parallel spaced-apart inclined leg members;

a pair of parallel spaced-apart substantially horizontal span members attached at one end to respective ones of said leg members;

a cross member extending between said span member;

a pivotal support member for centrally supporting said cross member at the top of said dome-shaped structure;

wheeled support means extending between the other ends of said leg members for positioning said other ends of said leg members along a track extending along at least a portion of the circumference of the base of said dome-shaped structure;

means comprising a carriage slidably mounted on said leg members for positioning said work platform at the height of said desired work location; and means for extending said work platform away from said inclined leg members in a substantially horizontal direction toward said desired work location.

2. An orbital service bridge as defined in claim 1 wherein said pivotal support member is supported by framework extending up from the base of said overlying dome structure.

3. An orbital service bridge as defined in claim 1 which further comprises at least one additional member removably attached at one end to said other ends of said span members, and an additional positioning means at the other end of said additional member for positioning said other end of said additional member along said track opposite said other ends of said leg members to assist in supporting said orbital service bridge prior to attachment of said span members to said pivotal support means.

4. An orbital service bridge for positioning a work platform at a desired work location within an overlying dome-shaped structure, comprising;

pivotal support means centrally disposed near the top of said overlying dome, said support means including a framework extending upward from the base of said dome-shaped structure;

a leg having its upper end pivotally supported by said pivotal support means;

wheeled truck means at the lower end of said leg member for positioning said lower end along a track extending along at least a portion of the circumference of the base of said domed area; and means comprising a carriage movably supported on said leg for positioning said work platform at the height of said desired work location.

5. An orbital service bridge for servicing a desired work location within an overlying dome-shaped structure, comprising, in combination:

pivotal support means centrally disposed near the top of said overlying dome;

a leg member having its upper end pivotally supported by said pivotal support means;

means including a track extending along at least a portion of the circumference of the base of said domed area, and a wheeled truck attached to the bottom end of said leg member and arranged for movement along said track for positioning said leg member at a location along said circumference corresponding to the position of said work location;

a work platform;

means comprising a carriage mounted for reciprocation along said leg member for positioning said work platform at the height of said desired work location; and means for extending said work platform away from said leg member in a substantially horizontal direction toward said desired work location.

6. An orbital service bridge for servicing a desired work location within an overlying dome-shaped structure, comprising, in combination:

pivotal support means centrally disposed near the top of said overlying dome;

a leg member having its upper end pivotally supported by said pivotal support means;

means including a track extending along at least a portion of the circumference of the base of said domed area, and a wheeled truck attached to the bottom end of said leg member and arranged for movement along said track for positioning said leg member at a location along said circumference corresponding to the position of said work location;

a work platform;

means comprising a carriage mounted for reciprocation along said leg member for posttioning said work platform at the height of said desired work location; and means including at least one additional support member, one end of said additional support member being removably joined to the pivotally mounted end of said leg member, and means for positioning said other end of said additional support member along said track opposite said other end of said leg member, to assist in supporting said orbital service bridge prior to attachment of said leg member to said pivotal support means.

7. An orbital service bridge for servicing a desired work location within an overlaying dome-shaped structure, comprising, in combination:

pivotal support means centrally disposed near the top of said overlaying dome;

a leg member having its upper ends pivotally supported by said pivotal support means;

means including a track extending along at least a portion of the circumference of the base of said domed area, and a wheeled truck attached to the bottom end of said leg member and arranged for movement along said track for positioning sail leg member at a location along said circumference corresponding to the position of said work location;

a work platform; and means comprising a carriage mounted for reciprocation along said leg member for positioning said work platform at the height of said desired work location, wherein said pivotal support member is supported by a framework extending upward from the base of said dome-shaped structure.

* * * * *